United States Patent [19]

Damiano

[11] 4,417,177

[45] Nov. 22, 1983

[54] LAMP CONTROL DEVICE

[76] Inventor: Joseph C. Damiano, 4931 E. Acoma Dr., Scottsdale, Ariz. 85254

[21] Appl. No.: 351,415

[22] Filed: Feb. 23, 1982

[51] Int. Cl.[3] ..... H05B 37/00; H01J 7/44

[52] U.S. Cl. ..... 315/73; 315/119; 315/127

[58] Field of Search ..... 315/127, 119, 73

[56] References Cited

U.S. PATENT DOCUMENTS 4,039,893 8/1977 Corbley ..... 315/127

4,217,522 8/1980 Strauss ..... 315/119

4,229,678 10/1980 Petro ..... 315/73

*Primary Examiner*—Harold Dixon

[57] ABSTRACT

A lamp control device in which the lamp circuit is controlled in accordance with a signal generated from a condition of an evacuated outer seal envelope. The signal being converted into a control action at the end of occurence of the signal so that the lamp heater contained in an inner envelope is rendered inoperable thereafter.

5 Claims, 5 Drawing Figures

FIG. 4
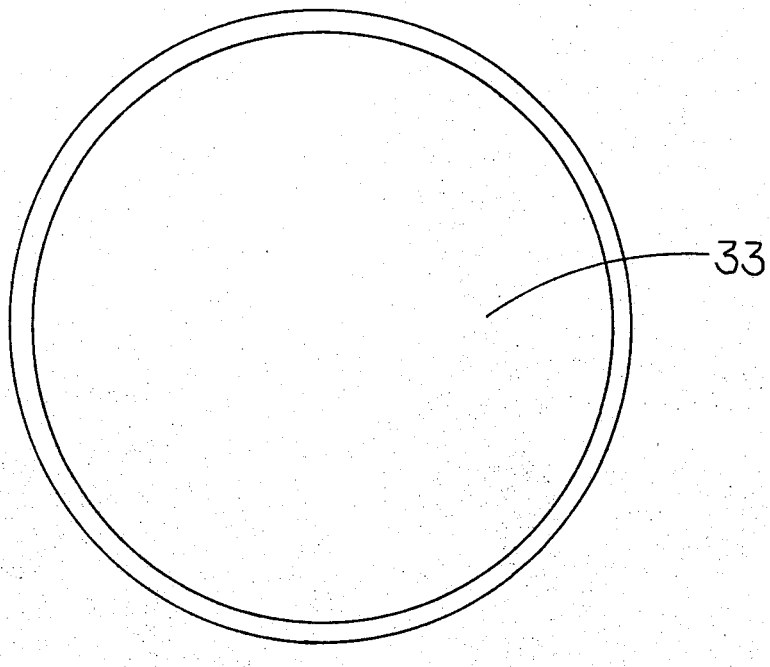
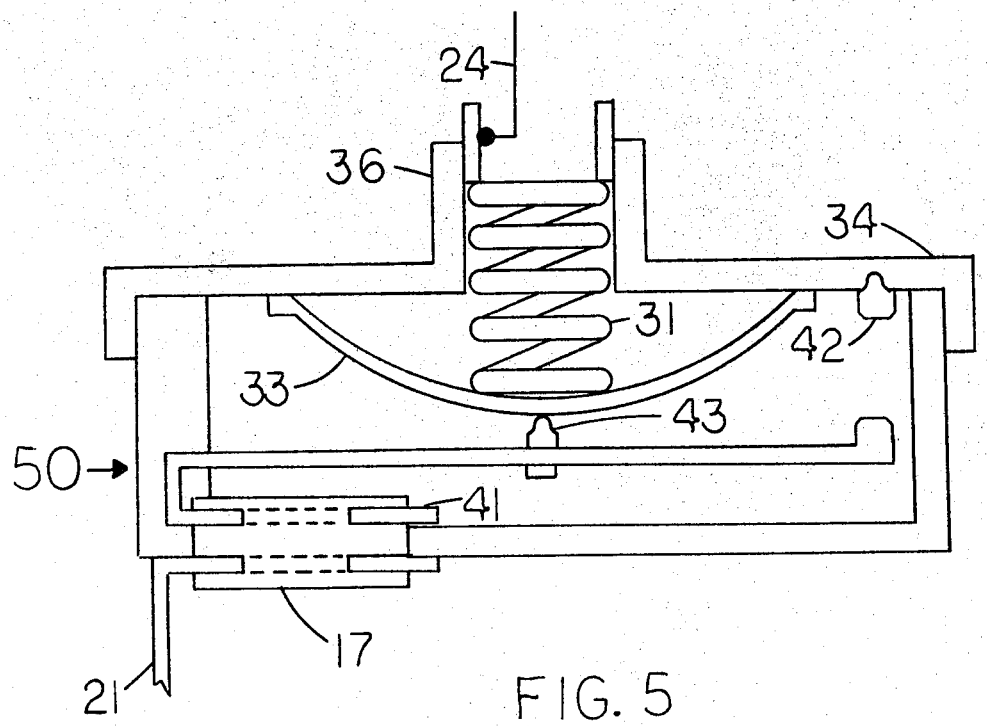
FIG. 5

LAMP CONTROL DEVICE

BACKGROUND OF THE INVENTION

A sealed beam lamp of the type using an inner pressure filled bulb, which is common is the inner halogen bulb enclosing the lamp heater. The problem with this type of lamp is it will continue to burn even though the outer seal envelope is broken. There are currently many lamp devices of this type being used in lighting areas which are closely associated with flammable materials. Although these lamps are manufactured under certain guidelines and standards, they are often subjected to rough use which can cause breakage of the outer seal envelope while the lamp is still operational. Thus there has been a particular need for a simple, and reliable lamp control means which will prevent the operation of the lamp filament heater corresponding to the condition of the outer seal envelope. In brief, the present invention is particularly concerned with this type of situation and with providing a means to render the lamp circuit inoperable by obtaining a signal from the outer envelope which can be used for initiating a control action to render the lamp circuit inoperable.

SUMMARY OF THE PRESENT INVENTION

The present invention is directed to improve means for providing an effective solution to those previously mentioned problems. A lamp control device is which the lamp circuit is controlled in accordance with a marked change related to a condition of an outer seal envelope so that the lamp heater contained in the inner envelope is rendered inoperable when the outer seal envelope is broken. Specifically, this is accomplished by using an evacuated outer sealed envelope in conjunction with a detector envelope means which is responsive for initiating a control action to control a lamp circuit cutout means, thereby controlling the lamp circuit itself. Various other aspects and features of the invention will be apparent from a consideration of the accompanying specifications, claims, and drawings.

BRIEF DESCRIPTION OF DRAWINGS

FIG. 4: The face view of the detector envelope in FIG. 3.

FIG. 5: Schematic view of the outer enclosure.

DESCRIPTION OF THE PREFERRED EMBODIMENT

Figure 1:
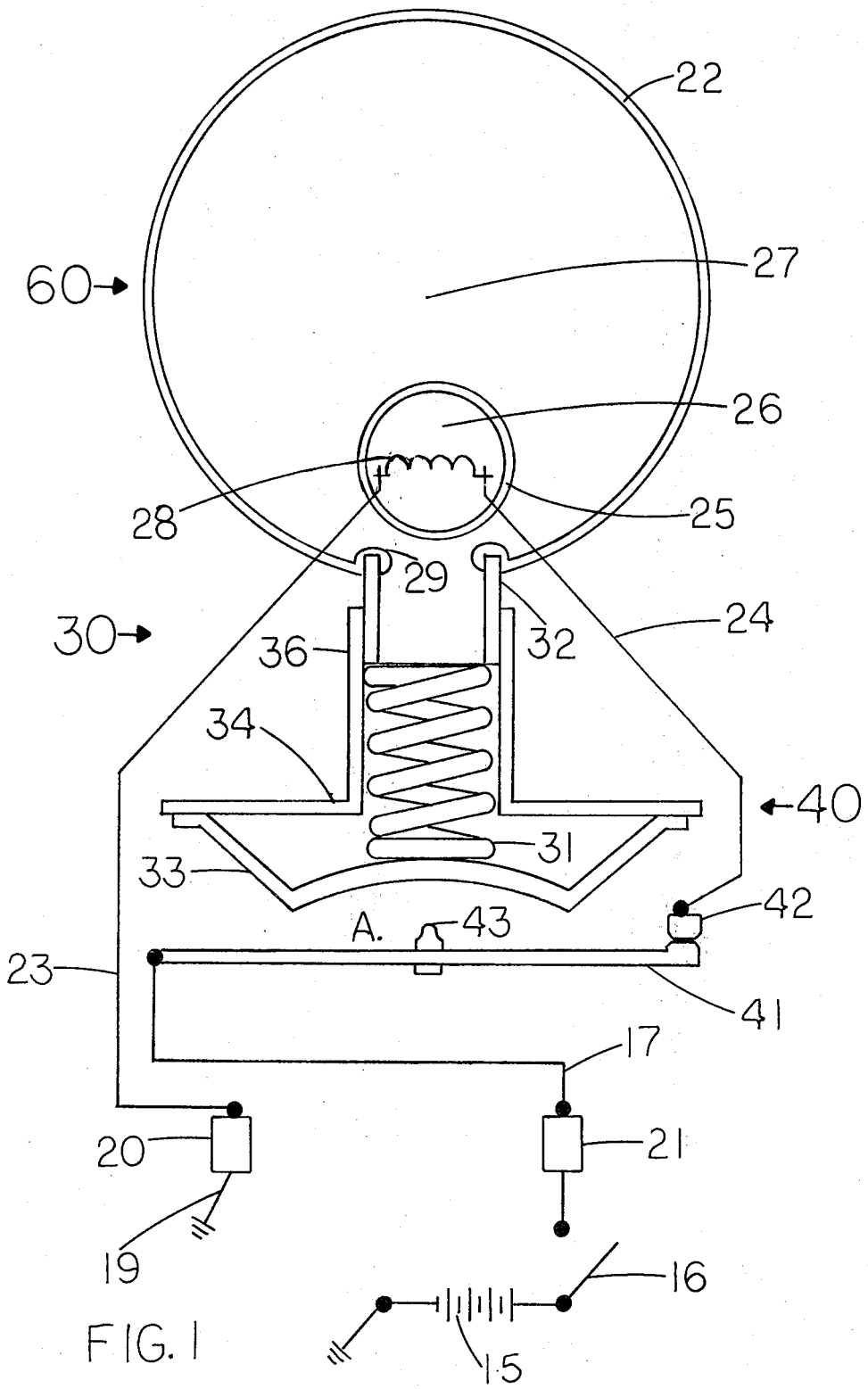
FIG. 1: A schematic view of an incandescent lamp, with the lamp control means according to this invention, as its use would be in an application with an automobile battery.
Figure 2:
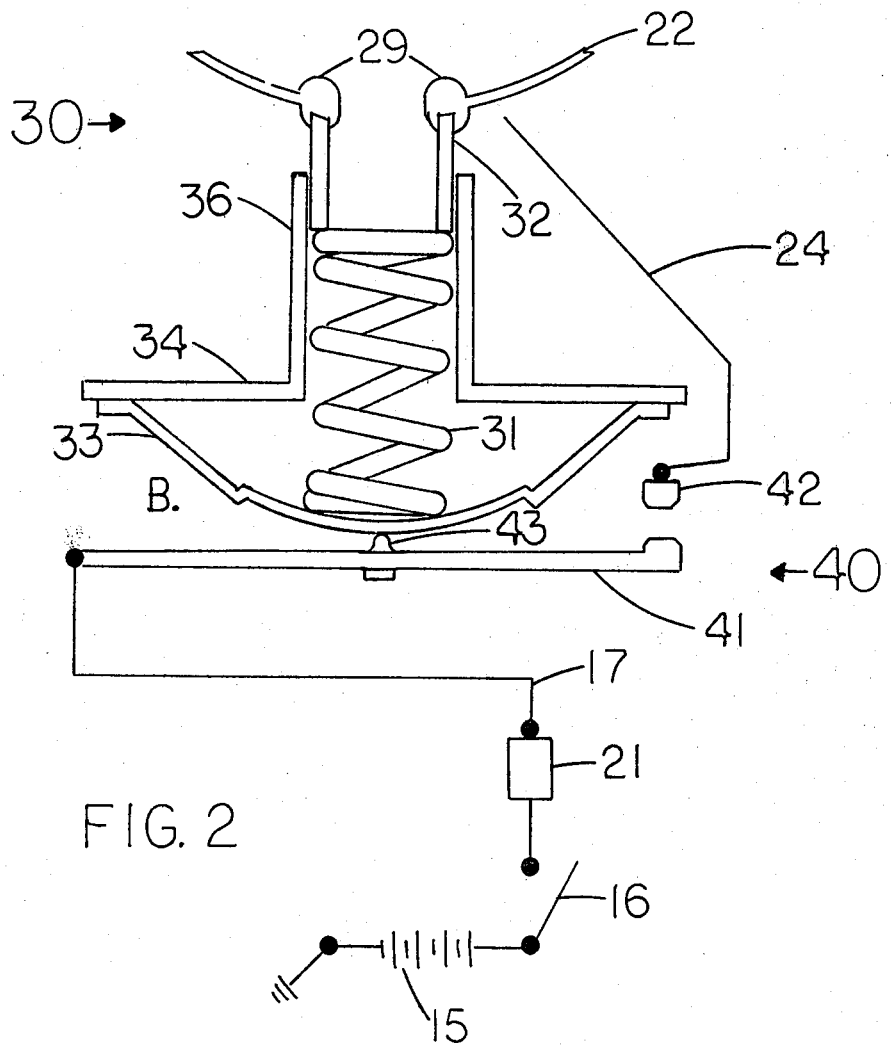
FIG. 2: A schematic view of the lamp control means illustrating the mode of operation in rendering the lamp circuit inoperable as it would apply in FIG. 1.
Figure 3:
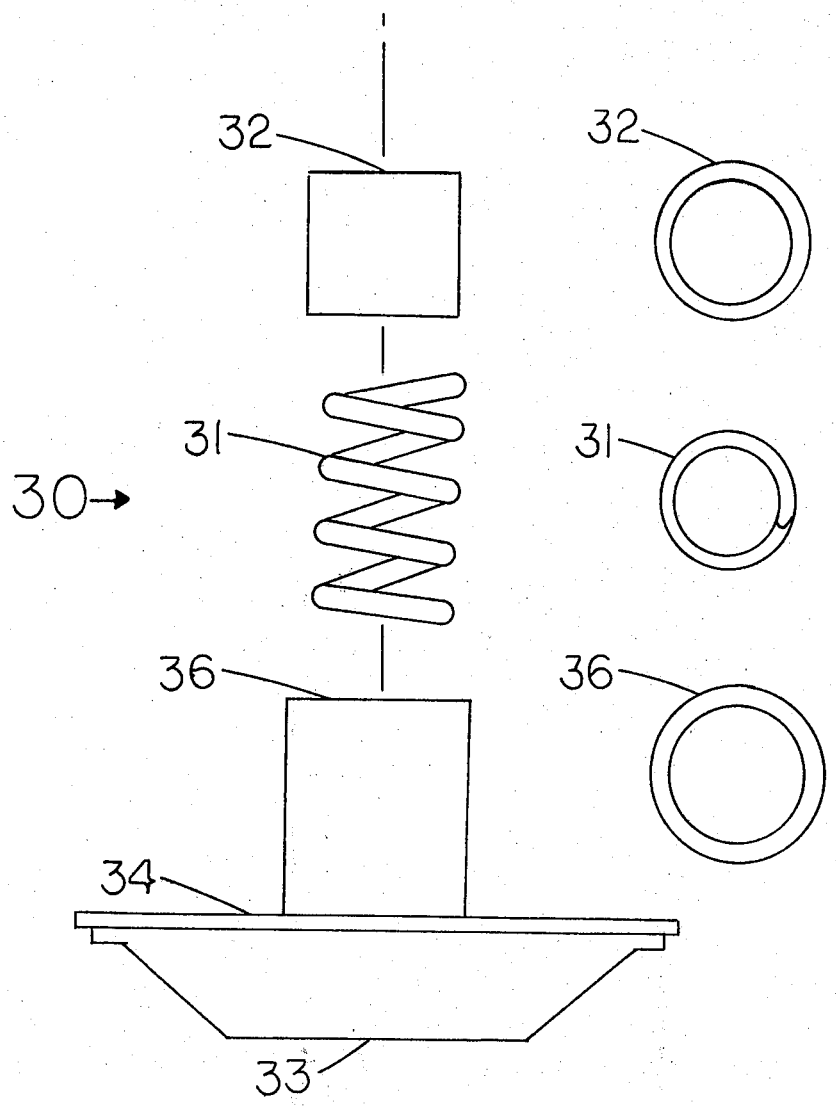
FIG. 3: An exploded top and side view of the detector envelope means as illustrated in FIG. 1 and FIG. 2.

Turning now to the features of the preferred embodiment illustrated in the accompanying drawings. To demonstrate the present invention, initial reference is made to FIG. 1, numeral 60, showing a typical incandesent lamp which is schematically shown in the drawing of the type having an inner gas-filled envelope 25 enclosing a tungsten coil filament 28, which is connected between and supported thereby a pair of lead-in conductors 23 and 24, of conventional formation for supporting the inner envelope 25 mounted inside an evacuated outer envelope 22. The reference number 26 is employed to indicate gas-filled and numeral 27 is used to indicate an evacuated condition. As best shown in FIG. 1, 2 and 3 of the drawings, the outer envelope 22 is provided with an extended passageway 32 therein illustrated by numeral 29. This connected passageway 32 may be preferrably of a tubular shaped metal so as to provide the connector means required to accomodate the present invention. Turning now to the feature of the present invention.

The reference number 30 indicates the detector envelope means having the form which when triggered by the condition of the outer envelope 22 therein assumes one of two states. The initial state which begins when the outer envelope 22 is sealed, and remains in this state of condition until such time as the outer envelope is however broken. The detector envelope 30 comprises a body portion 33, preferably of a thin flexible metal or metals which may be a circular dish-shape formation, and a metal base portion 34 having a connector passageway 36 extending outwardly of base portion 34. The hollow inside area of detector envelope 30 contains a spring 31 which is contained with in connector passageway 36, between the inner face portion 33, and connector 32 as best shown in FIG. 1 of the drawings. The outer sealed envelope 22 which is evacuated, causes spring 31's pressure to be overcomed. In other words, spring 31 is compressed between the inner face 33, and the rim portion of connector 32 as shown in FIG. 1, letter (a) of the drawings. The detector envelope 30 will now remain sufficiently stable within what is now referred to as 'a first stage', provided that the outer envelope 22 condition remains as sealed. If on the other hand, the seal of the outer envelope 22 is however broken, the detector envelope 30 will be responsive to this marked change so that spring 31 will then return with the flexible body portion 33 to form what is referred to as 'a final stage' to control the lamp circuit cutout means as best shown in FIG. 2 letter (b), as will be presently described. FIG. 4 shows the detector envelope 30 outer face portion towards the inside. Number 40 indicates the lamp circuit output means as shown in FIGS. 1 and 2 of the drawings. The lamp circuit cutout means comprises a flat blade 41 with an associated contact 42, flat blade 41 may be of spring stock, having an insulated contact 43 at which point requires applied pressure to disengage flat blade 41 from contact 42. Flat blade 41 is connected to a base terminal 21 through a conductor 17. Contact 42 is connected to the lead-in-coductor 24. Lead-in conductor is connected to a base terminal 20. Flat blade 41 is mounted with its insulated contact point 43 over the central axis of the outer face flexible body portion 33 there-over to engage contact 42, unless disengaged by means of the detector envelope 30 corresponding to the occurence of 'a final stage' condition of the outer envelope 22 as best shown In FIG. 2. The lamp circuit cutout means 40 is mounted in the outer enclosure 50 as shown in FIG. 5. It is to be understood that the lamp circuit cutout means may include an additional blade and contact for use in 'AC' type lamps to open the lamp circuit for both lead-in conductors at the same time. The mode of operation is that the detector envelope 30 engages flat blade 41 by pressing upon its insulated contact 43. This will cause flat blade 41 to be quickly disengaged from contact 42. Thus rendering cutout means 40 to open the lamp circuit. The detector envelope 30 also prevents flat blade 41 from again engaging contact 42. It is to be understood that this is in response of the final stage of detector envelope 30. I have shown lamp 60 as connected to an automobile battery 15 through a switch 16 which can be the conventionl light switch. Although switch 16 is shown as opened, it will be appreciated that when switch 16 is closed, current flows from the positive terminal of battery 15 through closed switch 16, through lamp 60 to ground at 19 which otherwise can be traced through lamp 60 turned on, through base terminal 21, conductor 17, there through cutout means 40, blade 41, contact 42, lead-in conductor 24, filament 28, lead-in conductor 23, and base terminal 20 to ground at 19. As soon however, as the seal of the outer envelope is broken, this cutout means 40 is rendered non-conductive through its blade 41 and contact 42 as described above. The final result will be that filament heater 28 is rendered inoperable there after. This is due to the fact that detector envelope 30's 'final stage' has blocked cutout means 40 from again becoming conductive through blade 41 and contact 42, hence no current can flow through the lamp circuit to ground. It will be noted that this lamp need not be on or connected for the same final results. While I have shown a specific embodiment of my invention for purposes of illustration, it is understood that the scope of the invention is limited solely by that of the appended claims.

I claim:

1. In an electric lamp device comprising an inner envelope enclosing lamp heater means for converting electrical energy into visible light mounted inside an evacuated sealed outer envelope, lamp circuit connector means for connection of said lamp heater means to an electrical voltage generating means, detector envelope means connected to said outer envelope for controlling the operation of said lamp heater means, wherein said detector means is a pressure sensitive means responsive to said vacuum and external pressure, lamp circuit cutout means connected between said lamp heater means and said lamp circuit connector means under the control of said detector envelope means for controlling the lamp circuit.

2. The combination as claimed in claim 1 wherein said detector envelope means includes means responsive to a condition of said evacuated sealed outer envelope for initiating a control action corresponding to a marked change in said condition.

3. The combination as claimed in claim 2 wherein said marked change indicates said outer envelope seal is broken.

4. The combination as claimed in claim 1 wherein said lamp circuit cutout means is controlled by said detector envelope means for rendering said lamp heater means inoperative.

5. The combination as claimed in claim 1 wherein said detector envelope means comprising a first stage means responsive to said condition and a final stage means responsive to said marked change in said condition for rendering said lamp heater means inoperative thereafter.

* * * * *